US008656993B2

(12) United States Patent
Brumboiu

(10) Patent No.: US 8,656,993 B2
(45) Date of Patent: Feb. 25, 2014

(54) MEASURING GAS LOSSES AT A RIG SURFACE CIRCULATION SYSTEM

(75) Inventor: Aurel Brumboiu, Calgary (CA)

(73) Assignee: Weatherford/Lamb, Inc., Houston, TX (US)

( * ) Notice: Subject to any disclaimer, the term of this patent is extended or adjusted under 35 U.S.C. 154(b) by 377 days.

(21) Appl. No.: 13/051,573

(22) Filed: Mar. 18, 2011

(65) Prior Publication Data

US 2012/0234599 A1 Sep. 20, 2012

(51) Int. Cl.
*E21B 47/10* (2012.01)

(52) U.S. Cl.
USPC ..... 166/250.01; 166/337

(58) Field of Classification Search
USPC ..... 166/337, 250.01; 175/42, 69, 71, 205; 73/152.04; 436/25, 30, 181; 702/9
See application file for complete search history.

(56) References Cited

U.S. PATENT DOCUMENTS

| | | | | |
|---|---|---|---|---|
| 2,745,282 | A | 5/1956 | Rochon | |
| 4,765,182 | A | 8/1988 | Boone | |
| 5,277,263 | A | 1/1994 | Amen | |
| 7,844,400 | B1 | 11/2010 | Selman et al. | |
| 2004/0065440 | A1 * | 4/2004 | Farabee et al. | 166/358 |
| 2007/0043248 | A1 * | 2/2007 | Wu et al. | 585/521 |
| 2010/0089120 | A1 | 4/2010 | Hanson | |
| 2010/0139386 | A1 | 6/2010 | Taylor | |
| 2010/0198533 | A1 | 8/2010 | Peacock et al. | |
| 2011/0000294 | A1 | 1/2011 | Kimour et al. | |

OTHER PUBLICATIONS

Weatherford International, Ltd., "Introducing the New GC-Tracer," obtained from www.inter-log.com/pros_gctracer.html generated on Feb. 3, 2011, 2 pages.
"Surface Mud System," Reproduced from Mud Logging Principles & Interpretation, written and compiled by EXLOG Staff, Edited by Alun Whittaker, 1985.
"New System Provides Continuous Quantitive Analysis of Gas Concentration in the Mud During Drilling," by G.L. Roberts, V.C. Keiessidis, and J.M. Williams, Copyright 1991 Society of Petroleum Engineers, SPE Drilling Engineering, Sep. 1991, 10 pages.

* cited by examiner

*Primary Examiner* — Cathleen Hutchins
(74) *Attorney, Agent, or Firm* — Wong, Cabello, Lutsch, Rutherford & Brucculeri LLP

(57) ABSTRACT

A technique for improving the capability of measuring gas losses at the rig surface area uses a predetermined quantity of a preselected gas injected into the drilling fluid used in the drilling rig, which is then detected and compared to measure the gas loss. Various embodiments may use special-purpose gases. Other embodiments may use air or components of air, such as nitrogen or oxygen, as the gas to be detected and measured.

25 Claims, 3 Drawing Sheets

MEASURING GAS LOSSES AT A RIG SURFACE CIRCULATION SYSTEM

TECHNICAL FIELD

The present invention relates to the field of drilling rig systems, and in particular to a technique for measuring the gas losses in a surface circulation system of a drilling rig.

BACKGROUND ART

Conventional mud logging has been used for over 60 years for various purposes, including detection of oil- or gas-bearing sections while drilling. Other information may be obtained by mud logging that can be useful in determining coring and casing points, or for determination of over-balanced or under-balanced drilling conditions. Thus, mud logging is valuable both for economic and safety considerations.

Mud logging services typically provide a continuous reading of hydrocarbons, and use chromatographic analysis to give the concentrations of individual components. One problem with current mud logging systems is that there is a significant amount of error in the measurements, making the results often more qualitative than quantitative.

When a well is drilled, crushed rock and any contained fluids are released and transported to the surface in the drilling fluid. If geologists could separate those formation fluids from the drilling fluids, they could determine the quantity and type of the formation fluids contained in the formation. The accuracy of those determinations has been reduced because of an inability to measure the losses of gases in the rig surface system and the gas extraction mechanism.

The conventional gas logging of wells uses a gas trap, often installed at the possum belly, as the place to install the gas extraction equipment, far from the wellhead. This is the preferred installation spot because is the first one opened and accessible for installing the gas extraction device. The gas composition measured is known to be inaccurate because (i) quantifying the extraction from a classical gas trap has been difficult, and (ii) even if a quantitative extraction device and analyzer is available, the gas losses occurring between the bell nipple and possum belly have previously been unmeasured. Quantitative mud logging systems have been developed that attempt to more accurately identify and measure gas in the recovered drilling fluid, but those systems have been hampered by the unknown amount of gas lost at the rig surface.

In one attempt to gain information about the surface losses, a full-scale 150 bbl test facility was built with flow rates of up to 1000 gallons per minute to be pumped through the bell nipple and down a return line into the possum belly. Metered natural gas was injected into the mud. An ejector module measured gas extracted from open space in the bell nipple and the return line. Additional samples were taken from the possum belly, and compared with the measurements made by the detector module. The study concluded that almost 50% of the gas is lost in the surface system before the drilling fluid reaches the possum belly.

The technique used in the study had significant limitations. Different rig topologies, such as open trough sections, would require different configurations of the measurement equipment. According to the authors, the technique was only usable on water-based drilling fluids. The technique also required two independent analyzers. In addition, the results did not provide good quantitative gas data that resulted in the development of interpretive packages. Such differential techniques imply the installation of a first gas sampling location close to the bell nipple, which is a hard to access location that implies adaptation and/or perforations of the annulus or flow line and involves the cooperation of the drilling contractor for such changes. The modifications required in the area around the bell nipple at the top of the annulus can cause safety and efficiency concerns. In addition, such a location creates maintenance service difficulties.

Techniques such as described above are very laborious and expensive, producing results that may not be applicable on rigs with different topologies. If one attempts to figure out the losses on a pilot rig using the above mentioned technique and then tries to apply a loss formula on further rigs using just the possum belly sampling location, then the results would vary from rig to rig depending on the bell nipple opening to air, the length and inclination of the flow line, different turbulence regimes for the mud flow, etc., making development of a gas losses formula more difficult. Thus, to the inventor's knowledge, the technique described above has never been used in a production environment, but was only intended as a prototype and its use was mostly to point out that such gas losses exist and are quite significant.

BRIEF DESCRIPTION OF DRAWINGS

The accompanying drawings, which are incorporated in and constitute a part of this specification, illustrate an implementation of apparatus and methods consistent with the present invention and, together with the detailed description, serve to explain advantages and principles consistent with the invention. In the drawings.

DESCRIPTION OF EMBODIMENTS

In the following description, for purposes of explanation, numerous specific details are set forth in order to provide a thorough understanding of the invention. It will be apparent, however, to one skilled in the art that the invention may be practiced without these specific details. In other instances, structure and devices are shown in block diagram form in order to avoid obscuring the invention. References to numbers without subscripts or suffixes are understood to reference all instance of subscripts and suffixes corresponding to the referenced number. Moreover, the language used in this disclosure has been principally selected for readability and instructional purposes, and may not have been selected to delineate or circumscribe the inventive subject matter, resort to the claims being necessary to determine such inventive subject matter. Reference in the specification to "one embodiment" or to "an embodiment" means that a particular feature, structure, or characteristic described in connection with the embodiments is included in at least one embodiment of the invention, and multiple references to "one embodiment" or "an embodiment" should not be understood as necessarily all referring to the same embodiment.

A technique for allowing the capability of measuring gas losses at the rig surface area uses a predetermined quantity of a preselected gas injected into the drilling fluid at the rig surface at a convenient spot before pumping it downhole, which is then detected at a mud returning spot at the surface and compared in order to measure the gas loss. Various embodiments may use special-purpose gases, air, or air components such as nitrogen or oxygen as the gas to be detected and measured.

Preferably, the gas may be injected without any modification to the rig components in the area around the bell nipple, avoiding safety issues that may arise in approaches such as described above. In some embodiments, the injection may be performed by the personnel running the gas analyzer equipment, without interfering with the regular work of the personnel on the drilling floor.

Figure 1:
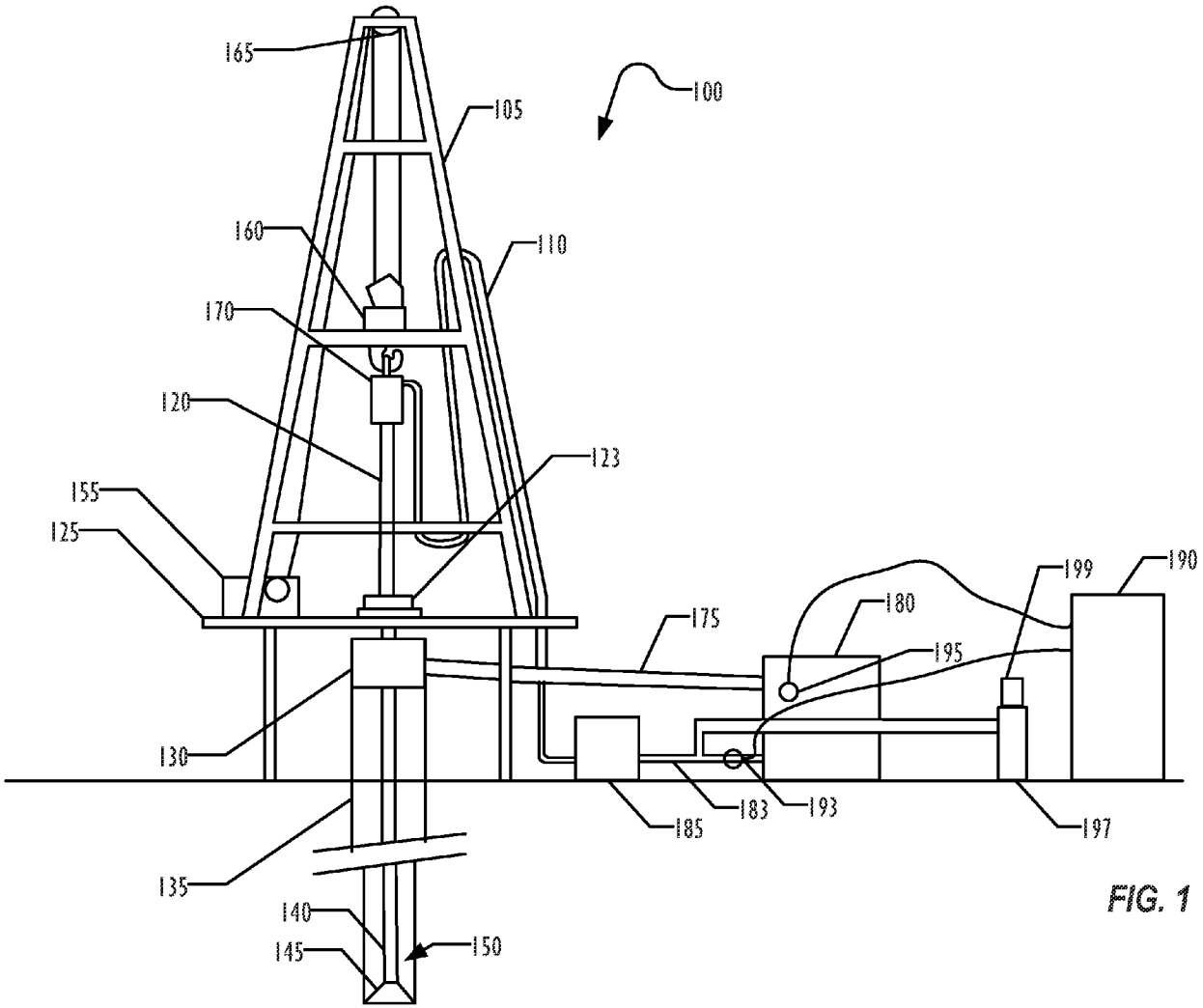
FIG. 1 is a diagram illustrating a system for measuring gas losses at a drilling rig surface according to one embodiment.

FIG. 1 is a diagram illustrating a system for measuring gas losses at a rig surface according to one embodiment. In this system, a drilling rig 100 comprises a number of conventional elements, including a derrick 105 mounted on a rig floor 125. A motor 155 drives a crown block 165 to raise and lower a traveling block 160. A swivel 170, from the traveling block 160, connects to the top of a kelly drive 120. The kelly drive 120 is connected to the drill string 140 at the end of which is connected a drill bit 145 for drilling the well. A rotary table 123 provides rotary motion to the kelly drive 120, causing rotation of the drill string 140 and drill bit 145. Other conventional drilling rig elements are omitted for clarity.

Drilling mud is pumped by a mud pump 185 from a mud tank 180. The drilling mud flows through tubing 110 into the drill string 140 at the swivel 170. The drilling mud then flows downhole, exiting at the drill bit 145 and returning up through an annulus 150 between the drill string 140 and the casing 135 (or an open borehole) to a bell nipple 130. An output of the bell nipple 130 is connected to a flow line 175 through which the mud leaves the annulus 150 and returns to the mud tank 180. The mud tank (sometimes called header box or possum belly) 180 typically allows the installation of a gas extraction device (gas trap) 195 for trapping gas entrained in the mud. Although not shown in FIG. 1, the header box 180 typically allows for cuttings to settle and gasses to be released and also provides a reduced mud flow over a shale shaker (not shown) that excludes the rest of the cuttings that have been carried up from the drill bit in the returning mud. The mud can then be reconditioned as necessary in some other successive tanks (not shown) and re-pumped downhole. For simplicity of the drawing, the mud is shown in FIG. 1 as supplied from the tank 180 for pumping back downhole.

The drilling rig illustrated in FIG. 1 is illustrative and by way of example only, and the gas loss measurement technique described herein may be performed with any desired type of drilling rig. For example, instead of a kelly drive 120 and rotary table 123, a drilling rig using a top drive can also employ the gas loss measurement technique described below.

A marker gas from a measurement tank or cylinder 197 may be injected using a quantitative marker gas injection device (e.g., a gas regulator, flow meters, restrictors, mass flow meters, etc.) 199 into the mud line 183 from the mud tank 180 to the mud pump 185. In one embodiment, the quantitative injection device 199 may inject discontinuously (e.g., a few seconds at a time) of the marker gas into the drilling mud at predetermined times. An analyst may control the marker gas injection device 199 and the timings of such injection of the marker gas into the drilling mud. For example, the marker gas may be injected into the drilling mud at least once every 8 hours to allow repeated measurement of the rig surface gas losses. In other embodiments, predetermined amounts of the marker gas may be injected into the drilling fluid continuously.

A gas analyzer 190 is connected to a gas extraction probe 195, typically contained in the possum belly 180. The probe 195 can detect the presence of the marker gas, transmitting a sample of the marker gas to the gas analyzer 190 for analysis. The amount of gas measured by the gas analyzer 190, marker gas previously sampled by the probe 195, may then be compared with the quantity of marker gas that was injected into the mud line 183 to determine the amount of gas that was lost at the rig surface, (manually or by software). The gas extraction probe 195 and the gas analyzer 190 comprise a quantitative gas measuring system that allows the estimation of surface losses. Such quantitative gas measuring systems are relatively new to the mud logging industry and typically use either a semi-permeable membrane or a so-called Constant Volume Trap (CVT) as gas extraction device from the mud. They can be calibrated to read the correct gas amount per volume mud displaying it as different units as desired, such as Vol. gas/Vol. mud at STP condition, or Mols gas/Vol. mud, etc.

In this embodiment, no modification to the drilling rig 100 in the area around the bell nipple 130 is required to perform the rig surface gas measurement. Thus, safety issues related to the need to have personnel working in the area around the rotary table 123 and the bell nipple 130 to make modifications for gas measurement are therefore eliminated.

In such an embodiment, drilling rig personnel working on or near the rig floor 125 do not need to be involved with or even aware of the surface gas loss measurement system.

In one embodiment, the preselected marker gas may be chosen for ease of detection in the drilling mud, and may be a purposed composition of multiple gases. In one embodiment, the gas composition is a combination of ethane and methane. In other embodiments, the preselected marker gas may be a single type of gas selected for recognition by the gas analyzer 190. In some embodiments, the marker gas is injected directly into the drilling mud in gaseous form, as discussed in more detail below In one embodiment, the marker gas may be injected continuously into the drilling mud. In this embodiment, a background level of the marker gas may be measured before the injection point of the marker gas. In one embodiment, a second probe 193 can be used to provide data on the background level of the marker gas. As illustrated in FIG. 1, the second probe 193 may be connected to the same gas analyzer 190 as the first probe 195; in some embodiments, the second probe 193 may be connected to a second gas analyzer (not shown), similar to the gas analyzer 190. The gas losses can then be determined according to the formula $$Gl=Gi+Gb-Gm$$

Where Gl is the gas concentration loss at the surface circulation system; Gi is the quantitative amount of marker gas injected, typically expressed as a gas concentration per vol. mud, and typically calculated from the gas amount continuously injected by the injection device 199 and from the mud flow, which is usually known; Gb is the marker gas background concentration in the mud returning to the pump, as measured by probe 193; Gm is the marker gas concentration measured after returning from the well by probe 195 and analyzer 190.

In order to use this experimental determination of gas losses for a regular drilling situation without purposed injections of the marker target gas, one can define a loss factor K as follows:

$$K=(Gm-Gb)/Gi$$

Having such a loss factor determined and assuming a direct proportionality between the amount of gas loss and the gas injected then the gas losses of the bottom hole occurring gases during regular drilling can be computed as follows $$Gl=(Gm-Gb)(1-K)/K$$

Where Gm is now the marker gas type measured during regular drilling and coming from bottom hole.

Alternately, the marker gas may be injected discontinuously as a known flow amount for a known amount of time, typically a few seconds. The gas peak measured by the system at the possum belly may then be used to determine the losses. The gas measured at the possum belly will show up as a gas peak above a background level of the marker gas for a period of time. Integrating the marker gas amount over time and dividing by the total time for the marker gas peak show allows the computation of an average value for the amount of marker gas per volume of mud for that period. The volume of mud pumped during that period is typically known, thus one can calculate the amount of gas injected as gas per vol. mud and further one can express the total amount of gas lost by the time the gas is measured by the probe 195 for this gas injection, with the formula:

$$Gl=Gi-Gm$$

Where Gl and Gi have the same meaning as above, but now Gm is the amount of marker gas measured with the gas background amount subtracted as explained above at the peak integration. In order to use this experimental correspondence for the regular drilling conditions without marker gas injections, one can define again a loss factor as $$K=Gm/Gi$$

The gas losses during regular drilling for gases produced at the bottom hole may then be calculated as $$Gl=Gm(1-K)/K$$

Where Gm is now the gas peak measured during regular drilling when a bottom hole gas show is measured.

In such an embodiment, the second gas probe 193 may be eliminated, because the marker gas measured is taken above the background gas. The same holds true in the case of continuous injection by using a sudden change in the marker gas injection. The marker gas measured at the possum belly 180 will show a sudden change in the concentration, of a lower amount than the injected change. If the measured marker gas change amount is used as the measured gas reading, then the gas background automatically is cancelled, avoiding the need for a second marker gas probe 193 (and second gas analyzer 190).

Repeated measurement of gas losses is advisable because changes in the rig, such as changes in mud flow topology or the composition of the drilling fluid, may affect how much gas is lost at the rig surface. For example, a change in the mud lines to include open channels may provide greater opportunity for loss of gases. Similarly, changes in the mud flow in the flow lines may be caused by bringing up cuttings in the drilling fluid, which may build up on the bottom of the line. The buildup of cuttings on the bottom of the line may increase turbulence in the mud flow, resulting in higher gas losses. In addition, an increase in cuttings layered at the bottom of the flow line changes the open area of the mud inside the line, which will change the gas losses more or less proportionally.

In yet another embodiment, a predetermined amount of gas may be introduced during a connection. For example, a predetermined quantity of a predetermined chemical may be dropped into the drill string when it is opened for connecting another section of drill pipe. The predetermined chemical in a predetermined quantity, in reaction with the mud, liberates a predetermined quantity of gas. This technique is similar to the conventional calcium carbide method for determining the lag time, but now the amount of acetylene liberated from the reaction of the calcium carbide with the mud may be accurately quantified and used to calculate the amount of gas injected (liberated). In contrast, when performing lag tests, the amount of acetylene detected has not been quantified, but merely used to compute the lag time of the well. Other solid chemicals may be used. For example, solid powder injection of Al or Mg would react with an alkaline mud and release $H_2$ as a marker gas. However, even the though such chemicals are safe, the reaction is slow and can last tens of minutes, so that the reaction may not be completed by the time the mud returns to the surface. Another chemical is aluminum carbide, which releases methane as the target gas, but suffers from the same slow reaction time. Another chemical family is one of organometallic compounds, for example, trimethyl aluminum or dimethyl zinc, which would release methane as the reaction product, but they are known to be extremely pyrophoric, thus create safety concerns. The use calcium carbide was described above, which releases acetylene as a reaction product with the mud. Beside the safety concerns of handling it in some geographic areas, acetylene gas has a much higher solubility in the mud than methane. For example, 840 ml of acetylene can be held in solution in 1 liter of water at 30° C., in contrast to methane (28 ml) and ethane (36 ml). So if one is using acetylene as a marker gas for the surface losses estimation, a strong correction must be applied to estimate the methane (approximately 30 times) or for ethane (approximately 23.3). The comparison here was done with methane and ethane because these are the gases most likely to be released in the surface circulation system, being the less soluble in mud and being in the highest amount as downhole gas composition. Such corrections between the gas type extractability might be done experimentally in the laboratory and might not depend only on the solubility of the marker gas. In addition, having the marker gas identical to the one of interest in order to be more accurate would be desirable. One desirable chemical that accomplishes this is triethylenediamine bis(trimethylaluminum). This compound in reaction with water in the mud would release methane and in a smaller amount ethane. It is much safer than the above-mentioned organometallic compounds and is known as the non-pyrophoric replacement for the trimethyl aluminum in organic chemistry.

The marker gas losses may be considered as a function of the quantity of marker gas added to the drilling mud. The gas losses can then be expressed using a formula such as $$G=f(g)$$

Where g is the marker gas concentration measured by the probe 195 as described above, G is the marker gas concentration injected into the mud, and f is a function of the variable g. In order to get such a functional relationship a plurality of injections of different amount G may be performed, measuring the corresponding g for each. This might be performed either using chemical injections of different amount at the connections, either using the sudden step injection change if using the closed mud circuitry injections as described above. Once this functional relationship is determined, the gas losses during drilling as may be computed as $$Gl=f(g)-g$$

The function f(g) may vary depending on the mud composition, marker gas, and topology of the drilling rig 100, but once determined might be used to continuously monitor (or compute) the gas losses during drilling and not only during the gas injections. During drilling, the variable g will be the regular gas reading from the gas measurement system (190, 195).

Figure 2:
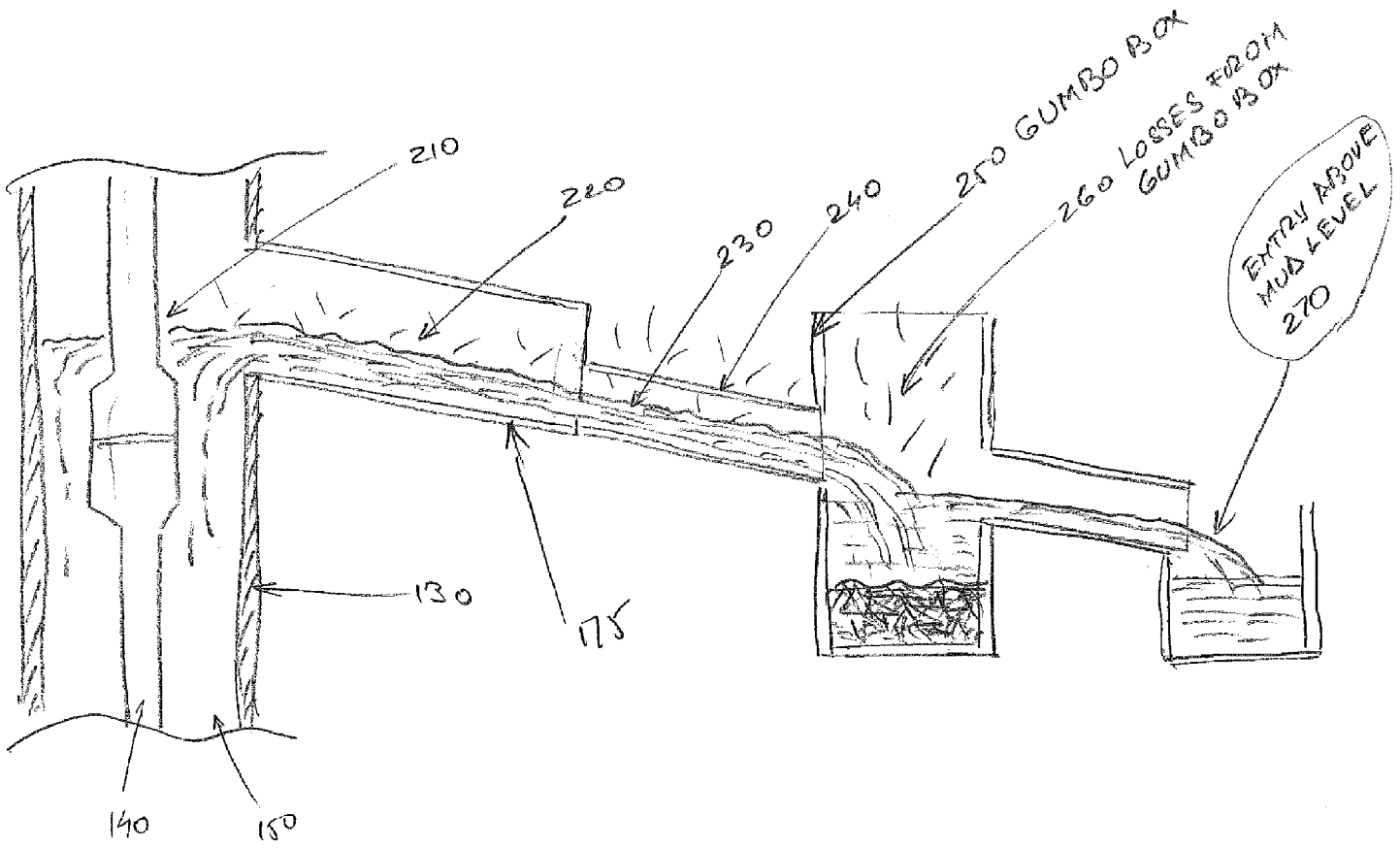
FIG. 2 (PRIOR ART)
FIG. 2 is a diagram illustrating locations of gas losses at a drilling rig surface according to the prior art.

FIG. 2 illustrates some of the sources of losses of gas that can occur at the rig surface according to the prior art. These losses may be detected by the system illustrated in FIG. 1. In a situation with extensive gas cutting of the mud, gas produced from has been observed bubbling in the bell nipple at the air/mud interface 210 in the bell nipple 130. Loss of gas from the mud to the atmosphere is also known to occur extensively in the flow line 175, especially where the flow line 175 is not filled with mud (220), where changes in slope promote turbulence in the flow line (230), where sections of the flow line are open to the atmosphere (240), where mud flow enters a gumbo box 250 inside the open volume (260), and when the flow line enters the possum belly 180 above mud level (270). The geometry of the surface mud system will have considerable effect on the volume of gas left to be detected by the gas trap. The location of the flow line entry, the geometry of the mud flow, and the degree of turbulence all affect the efficiency of a gas collection system.

By using a system such as the embodiment illustrated in FIG. 1, these losses can be accurately measured. This measurement of surface gas loss, can allow a gas chromatography analyst to provide a better interpretation of the information produced by the gas analyzer 190.

Figure 3:
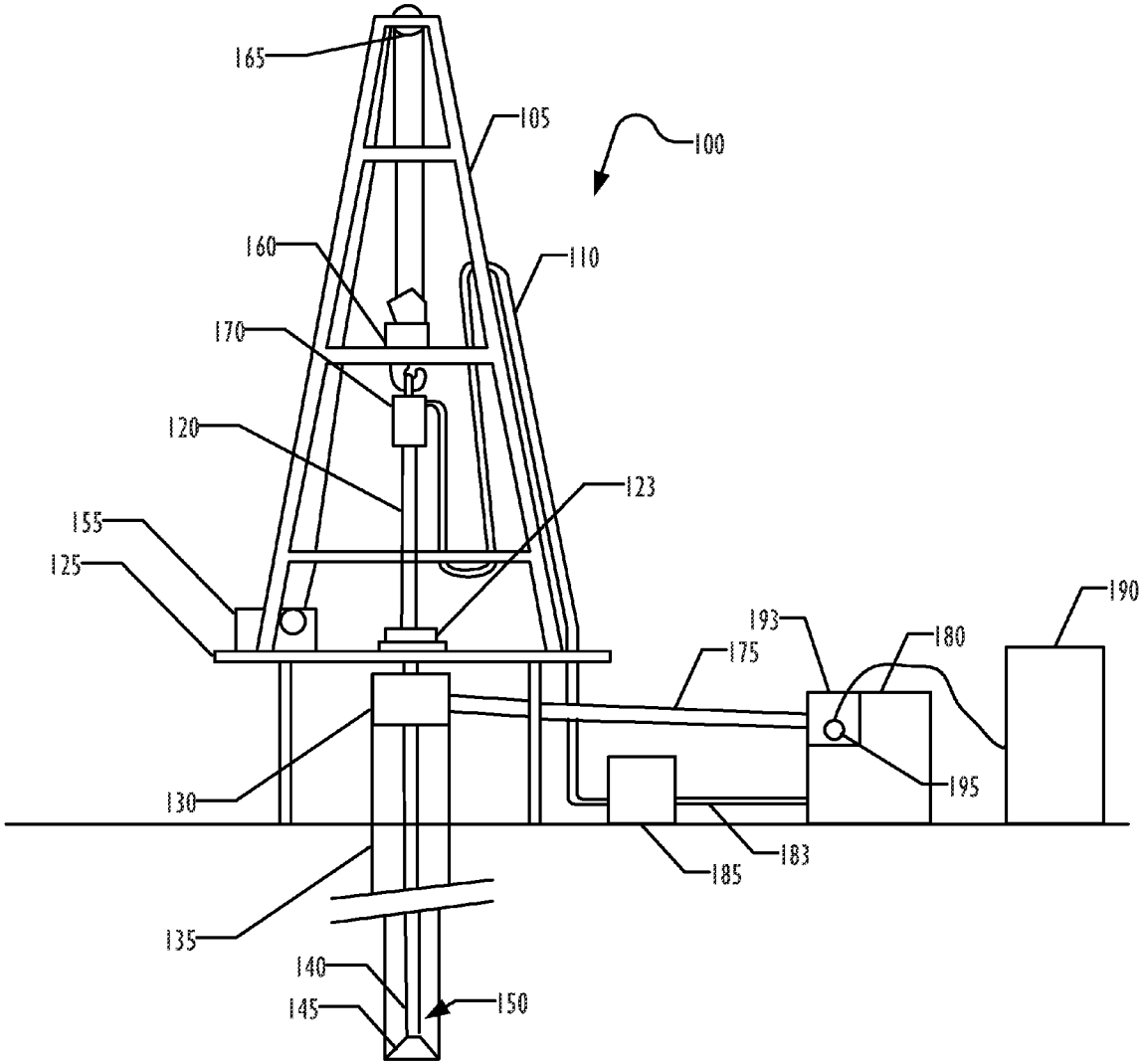
FIG. 3 is a diagram illustrating a system for measuring gas losses at a drilling rig surface according to another embodiment.

FIG. 3 illustrates a system for measuring surface gas loss according to another embodiment. In this embodiment, instead of using a marker gas tank 197 and the gas injection device 199 to insert the marker gas into the mud line 183 from the mud tank 180 to the mud pump 185, a simpler technique may be employed The gas analyzer 190 in this embodiment is capable of detecting entrained air or its major components $N_2$ or $O_2$ in the drilling fluid. At every connection of drill pipe to the drill string 140, the kelly drive 120 is disconnected from the drill string 140 to allow connection of a new section of drill pipe to the drill string 140. That new section of drill pipe is then run downhole, the kelly drive 120 is reconnected, the mud is pumped through the new section, and drilling can recommence. A similar procedure is employed in top drive drilling rigs. The new section of drill pipe has a predetermined known internal volume, thus a predetermined volume of air is entrained in the drilling mud after connection of the new section of drilling pipe to the drill string 140.

In such an embodiment, if the gas extraction device 195 and the gas analyzer 190 are capable of sampling and detecting air or a component of the air that was entrained in the drilling mud at time of connection, the gas analyzer 190 can use that measurement for purposes of determining the amount of gas lost at the rig surface as described above. In one embodiment, the gas extraction device 195 can sample and the analyzer 190 can detect the presence of air or its components, such as $N_2$ or $O_2$ in the drilling mud, letting the gas analysis unit 190 record a quantity of air or one of its components, such as $N_2$ or $O_2$ detected in the possum belly 180. By comparing this quantity of gas in the drilling mud as it reaches the possum belly 180 with the known volume of gas (air) that was contained in the new section of drill pipe added to the drill string 140 during the connection process, the gas analyzer 190 can determine the amount of gas lost at the rig surface, using similar computational analysis to that performed by the gas analyzer 190 in the embodiment illustrated in FIG. 1.

In another embodiment, also illustrated by FIG. 3, instead of using nitrogen or another component of air as the marker gas, a non-gaseous substance is introduced into the drill pipe 140 when making a new connection, as described above. In the past, calcium carbide has been used for estimating lag time, detecting the time required for the acetylene produced by the calcium carbide reaction with the drilling mud to reach the probe 195 of the gas analyzer 190. In this embodiment, typically a small friable packet containing a predetermined quantity of calcium carbide is simply dropped into the drill string when the kelly 120 is unscrewed from the drill string 140 to make a connection. The calcium carbide reacts with water in the drilling mud, producing a predetermined quantity of acetylene. Because of the safety risks associated with calcium carbide use in such an embodiment, as well as the requirement for rig personnel to be on the rig floor 125 in area of the bell nipple 130, rig operators may not wish to perform such operations as frequently as desired by a gas analyst. In some locations, calcium carbide use as described above may be prohibited by law or regulation because of the risks involved or for other reasons, such as environmental concerns. Nevertheless, where calcium carbide is used for determining lag time, the same operation may be used as a source of marker gas for calculating rig surface gas losses.

In the past, gas extraction systems and gas analysis units were unreliable and imprecise, and would not allow quantitative measurements of surface gas losses. More recent gas extraction systems and gas analyzers allow analysts to obtain reliable quantitative measurements of gases in the mud, and may allow continuous monitoring and analysis of entrained mud gases. One example of such an analyzer 190 is the GC-TRACER™ gas analyzer, using a semi-permeable membrane for the gas extraction probe 195, available from the assignee of the present application. Embodiments that use a marker gas that is selected as a component of air require an gas analyzer 190 that is capable of detecting such marker gases (air or its major components, such as $N_2$ or $O_2$) by the probe 195.

In one embodiment, multiple gas species may be measured. For example, a marker gas may be injected into the mud line 183 as illustrated in FIG. 1 and a different gas may be entrained in the mud during the connection procedure as described in relation to FIG. 3. Because different gases are liberated from the mud at different rates based mostly on their solubility in the mud but also based on their different extractability in turbulent regimes, measuring more than one gas using the techniques described above may provide better measurement of total gas losses than measurement of a single marker gas. In one such embodiment, the combined results from a chemical injection at a connection using the above-mentioned triethylenediamine bis(trimethylaluminum) and the air injection that naturally occurs at any connection as described above may be used. This will allow estimating the surface losses for at least three components at a time: methane, ethane and air (or one of its components). This will automatically give a relationship about their different extractability from that particular mud. During regular drilling and in the absence of other chemical injections at connections one has only the air (or its components) naturally injected in the mud. But applying the above-determined relationship between its extractability and the one for methane and ethane, one can easily estimate the losses of our gases of interest methane and ethane, which are the ones with the major losses.

It is to be understood that the above description is intended to be illustrative, and not restrictive. For example, the above-described embodiments may be used in combination with each other. Many other embodiments will be apparent to those of skill in the art upon reviewing the above description. The scope of the invention therefore should be determined with reference to the appended claims, along with the full scope of equivalents to which such claims are entitled. In the appended claims, the terms "including" and "in which" are used as the plain-English equivalents of the respective terms "comprising" and "wherein."

What is claimed is:

1. A method of measuring gas losses at a drilling rig surface, comprising:

adding a predetermined quantity of a preselected gas into a drilling fluid at the drilling rig surface;

measuring a second quantity of the preselected gas in the drilling fluid returned from downhole without modification of a bell nipple or output mud lines connected to the bell nipple;

measuring a background level of the preselected gas in the drilling fluid; and estimating gas losses occurring at the drilling rig surface based on the predetermined quantity of the preselected gas, the second quantity of the preselected gas, and the background level of the preselected gas.

2. The method of claim 1, wherein the act of estimating gas losses occurring at a drilling rig surface comprises:

establishing a quantitative relationship between the predetermined quantity of the preselected gas and the second quantity of the preselected gas; and estimating gas losses occurring at a drilling rig surface based on the quantitative relationship.

3. The method of claim 1, wherein the act of adding a predetermined quantity of the preselected gas into a drilling fluid at the drilling rig surface comprises:

adding a predetermined quantity of the preselected gas when making a connection to a drill string.

4. The method of claim 1, wherein the act of adding a predetermined quantity of the preselected gas into a drilling fluid at drilling rig surface comprises:

adding a predetermined quantity of a non-gaseous substance to the drilling fluid, wherein the non-gaseous substance reacts with the drilling fluid to produce the predetermined quantity of the preselected gas.

5. The method of claim 4, wherein the non-gaseous substance is calcium carbide and the preselected gas is acetylene.

6. The method of claim 4, wherein the non-gaseous substance is triethylenediamine bis(trimethylaluminum) and the preselected gas is a mixture of methane and ethane.

7. The method of claim 1, wherein the preselected gas is air.

8. The method of claim 1, wherein the preselected gas is a component of air.

9. The method of claim 1, wherein the predetermined quantity of the preselected gas is determined by an internal volume of air contained in a section of drill string.

10. The method of claim 1, wherein the act of adding a predetermined quantity of the preselected gas into a drilling fluid at a drilling rig surface comprises:

connecting a section of tubular containing a predetermined volume of air to a drill string in use by the drilling rig, wherein the preselected gas is a component of air.

11. The method of claim 10, wherein the preselected gas is nitrogen.

12. The method of claim 1, wherein the act of estimating gas losses occurring at a drilling rig surface comprises:

subtracting the second quantity from the predetermined quantity.

13. The method of claim 1, wherein the act of estimating gas losses occurring at a drilling rig surface comprises:

subtracting the second quantity of the preselected gas from a sum of the predetermined quantity of the preselected gas and the background level of the preselected gas in the drilling fluid.

14. The method of claim 1, wherein the act of adding a predetermined quantity of a preselected gas into a drilling fluid at the drilling rig surface comprises:

adding a continuous amount of the preselected gas into the drilling fluid; and changing the amount of the preselected gas into the drilling fluid, and wherein the act of measuring a second quantity of the preselected gas in the drilling fluid returned from downhole without modification of a bell nipple or output mud lines connected to the bell nipple comprises:

measuring a corresponding change in an amount of the preselected gas in the drilling fluid.

15. The method of claim 1, further comprising:

injecting a non-gaseous substance into the drilling fluid; and measuring a reaction product of the non-gaseous substance with the drilling fluid.

16. A system for measuring gas loss at a possum belly associated with a drilling rig, comprising:

a gas measuring system, comprising:

a probe configured to extract a first quantity of preselected marker gas;

a gas analyzer to measure a first quantity of preselected marker gas extracted by the probe; and software, comprising instructions stored on a non-transitory machine readable medium that when executed cause the gas measuring system to calculate gas loss occurring at a drilling rig surface as a comparison of the first quantity with a second quantity of the marker gas injected into a drilling fluid used by the drilling rig and a background level of the preselected marker gas, wherein the second quantity of the marker gas is injected into the drilling fluid without modifying a bell nipple used by the drilling rig.

17. The system of claim 16, further comprising:

a marker gas tank; and a marker gas injection system, configured to inject the second quantity of the marker gas into a mud line for pumping downhole.

18. The system of claim 16, wherein the marker gas is air or a component of air.

19. The system of claim 16, wherein the marker gas is nitrogen.

20. The system of claim 16, wherein the second quantity of the marker gas is determined by a volume of air enclosed by a section of drilling pipe.

21. The system of claim 16, wherein the instructions that when executed cause the gas measuring system to calculate gas loss comprise that when executed cause the gas measuring system to calculate gas loss after a connection of drilling pipe to a drill string used by the drilling rig.

22. The system of claim 16, wherein the second quantity of the marker gas is a predetermined continuous flow amount of the marker gas over a predetermined time.

23. The system of claim 16, wherein the marker gas is a mixture of ethane and methane.

24. The system of claim 16, wherein the marker gas is injected into the drilling fluid by adding a non gaseous substance at a connection, wherein the non-gaseous substance releases the marker gas in reaction with the drilling fluid.

25. A non-transitory machine readable medium, on which are stored instructions, comprising instructions that when executed by a machine cause the machine to:

insert a first quantity of a preselected gas into a drilling fluid at a drilling rig surface;

measure a second quantity of the preselected gas in the drilling fluid returned from downhole without modification of a bell nipple or output mud lines connected to the bell nipple;

measure a background level of the preselected gas in the drilling fluid; and calculate gas losses occuring at the drilling rig surface based on the first quantity of the preselected gas, the second quantity of the preselected gas, and the background level of the preselected gas.

* * * * *